US010791759B2

(12) United States Patent
Li et al.

(10) Patent No.: US 10,791,759 B2
(45) Date of Patent: Oct. 6, 2020

(54) LIQUID SUPPLY, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Yonglu Guo, Shenzhen (CN); Min Zheng, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 366 days.

(21) Appl. No.: 15/360,019

(22) Filed: Nov. 23, 2016

(65) Prior Publication Data

US 2017/0071260 A1 Mar. 16, 2017

(30) Foreign Application Priority Data

Nov. 25, 2015 (CN) ..... 2015 2 0951321 U

(51) Int. Cl.
*A24F 47/00* (2020.01)
*B65D 43/20* (2006.01)
*A61M 15/06* (2006.01)

(52) U.S. Cl.
CPC ..... *A24F 47/008* (2013.01); *B65D 43/20* (2013.01)

(58) Field of Classification Search
None
See application file for complete search history.

(56) References Cited

U.S. PATENT DOCUMENTS 2,863,676 A * 12/1958 Upham ..... F16L 37/367 137/351
3,425,414 A * 2/1969 La Roche ..... A61M 11/02 128/203.21
9,955,734 B2 * 5/2018 Lin ..... A24F 47/008
2010/0229881 A1 * 9/2010 Hearn ..... A24F 47/002 131/273
2010/0242975 A1 * 9/2010 Hearn ..... A24F 47/002 131/273
2014/0109905 A1 * 4/2014 Yamada ..... A61M 15/06 128/203.27
2014/0109921 A1 * 4/2014 Chen ..... A24F 47/008 131/273

(Continued)

*Primary Examiner* — Thor S Campbell
(74) *Attorney, Agent, or Firm* — Cheng-Ju Chiang

(57) ABSTRACT

The present disclosure relates to an atomizer includes an atomizing device and a liquid supply. The atomizing device includes an engaging part. The liquid supply includes a liquid chamber. The liquid supply includes a connecting end and a liquid outlet defined in the connecting end. The engaging part defines a liquid inlet through which tobacco liquid can flow into the atomizing device. The liquid supply further includes a sliding block slidable between a first position and a second position. When the sliding block is in the first position, the sliding block seals the liquid outlet; when the sliding block is in the second position, the liquid outlet is opened. The engaging part is capable of sliding along a predetermined track to form a snap-fit connection with the connecting end, and simultaneously driving the sliding block to move from the first position to the second position.

11 Claims, 6 Drawing Sheets

(56) References Cited

U.S. PATENT DOCUMENTS

| | | | | |
|---|---|---|---|---|
| 2015/0342256 | A1* | 12/2015 | Chen | H05B 3/06 392/404 |
| 2016/0135504 | A1* | 5/2016 | Li | A24F 47/008 392/395 |
| 2016/0150828 | A1* | 6/2016 | Goldstein | A24F 47/008 392/387 |
| 2016/0316820 | A1* | 11/2016 | Liu | A24F 47/008 |
| 2017/0208863 | A1* | 7/2017 | Davis | A24F 47/008 |
| 2017/0303596 | A1* | 10/2017 | Chen | A61M 11/04 |
| 2017/0360092 | A1* | 12/2017 | Althorpe | A24F 47/008 |
| 2017/0367407 | A1* | 12/2017 | Althorpe | A24F 47/008 |
| 2018/0007962 | A1* | 1/2018 | Hunt | A24F 47/008 |
| 2018/0098575 | A1* | 4/2018 | Liu | H05B 3/04 |

* cited by examiner

LIQUID SUPPLY, ATOMIZER AND ELECTRONIC CIGARETTE HAVING SAME

TECHNICAL FIELD

The present invention relates to electronic cigarettes, and particularly to a liquid supply, an atomizer having same, and an electronic cigarette using same.

BACKGROUND ART

A typical atomizer includes a liquid supply and an atomizing assembly. The liquid supply is configured for storing tobacco liquid, and the tobacco liquid is usually sealed by aluminum foil. The atomizing assembly includes a pricking component. When the liquid supply is coupled to the atomizing assembly, the pricking component pierces the aluminum foil, so that the tobacco liquid flows into the atomizing assembly. However, when replacing the liquid supply with a new one, the tobacco liquid remained in the liquid supply may flow out and pollute the atomizing assembly. Accordingly, user experience of the atomizer is unsatisfactory.

What are needed, therefore, are a liquid supply, an atomizer having same, and an electronic cigarette using same, which can overcome the above shortcomings.

SUMMARY

The present disclosure relates to an atomizer includes an atomizing device and a liquid supply. The atomizing device includes an engaging part. The liquid supply includes a liquid chamber. The liquid supply includes a connecting end and a liquid outlet defined in the connecting end. The engaging part defines a liquid inlet through which tobacco liquid can flow into the atomizing device. The liquid supply further includes a sliding block slidable between a first position and a second position. When the sliding block is in the first position, the sliding block seals the liquid outlet; when the sliding block is in the second position, the liquid outlet is opened. The engaging part is capable of sliding along a predetermined track to form a snap-fit connection with the connecting end, and simultaneously driving the sliding block to move from the first position to the second position.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
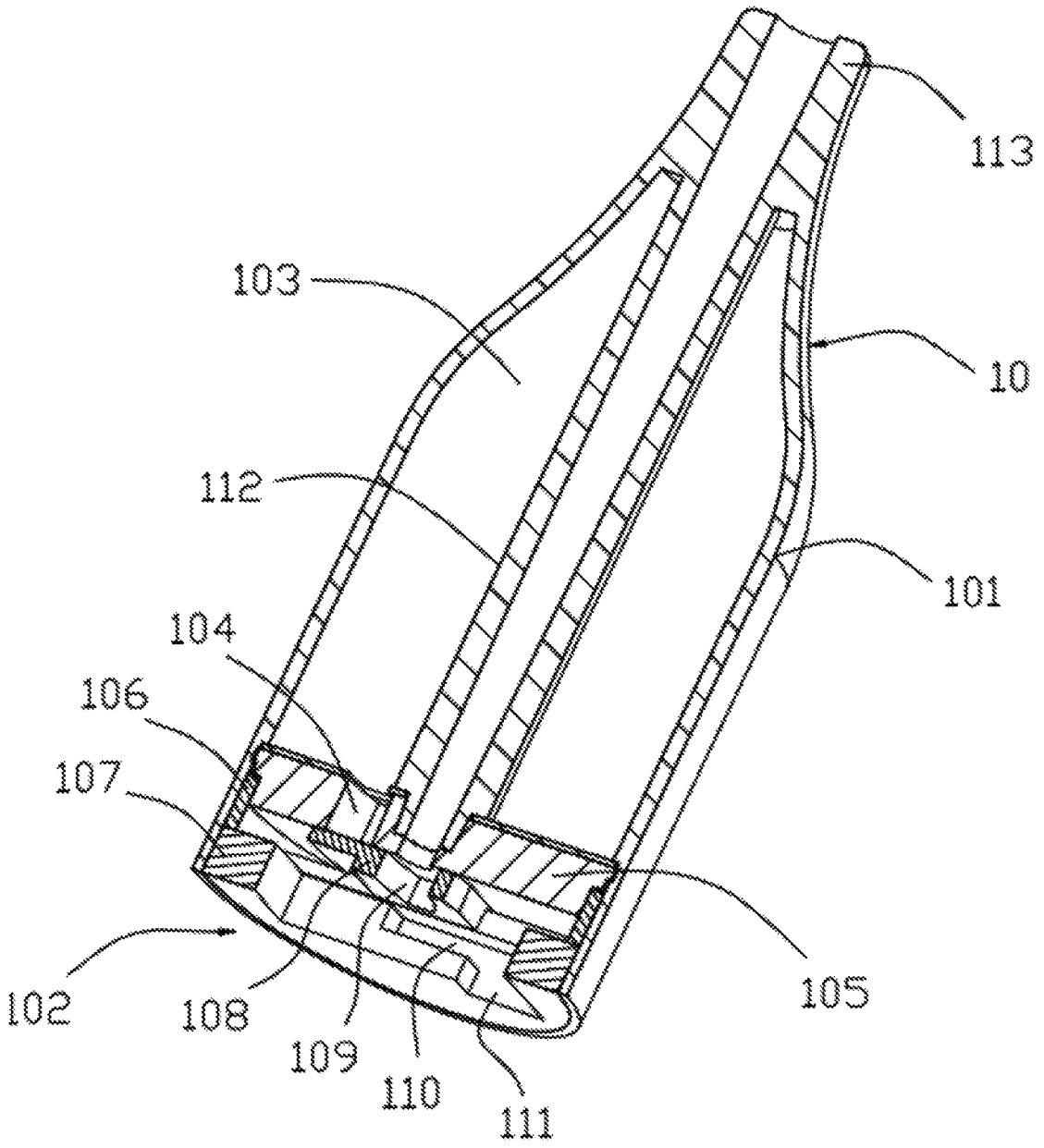
FIG. 1 is a partially cut-off perspective view of a liquid supply, according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
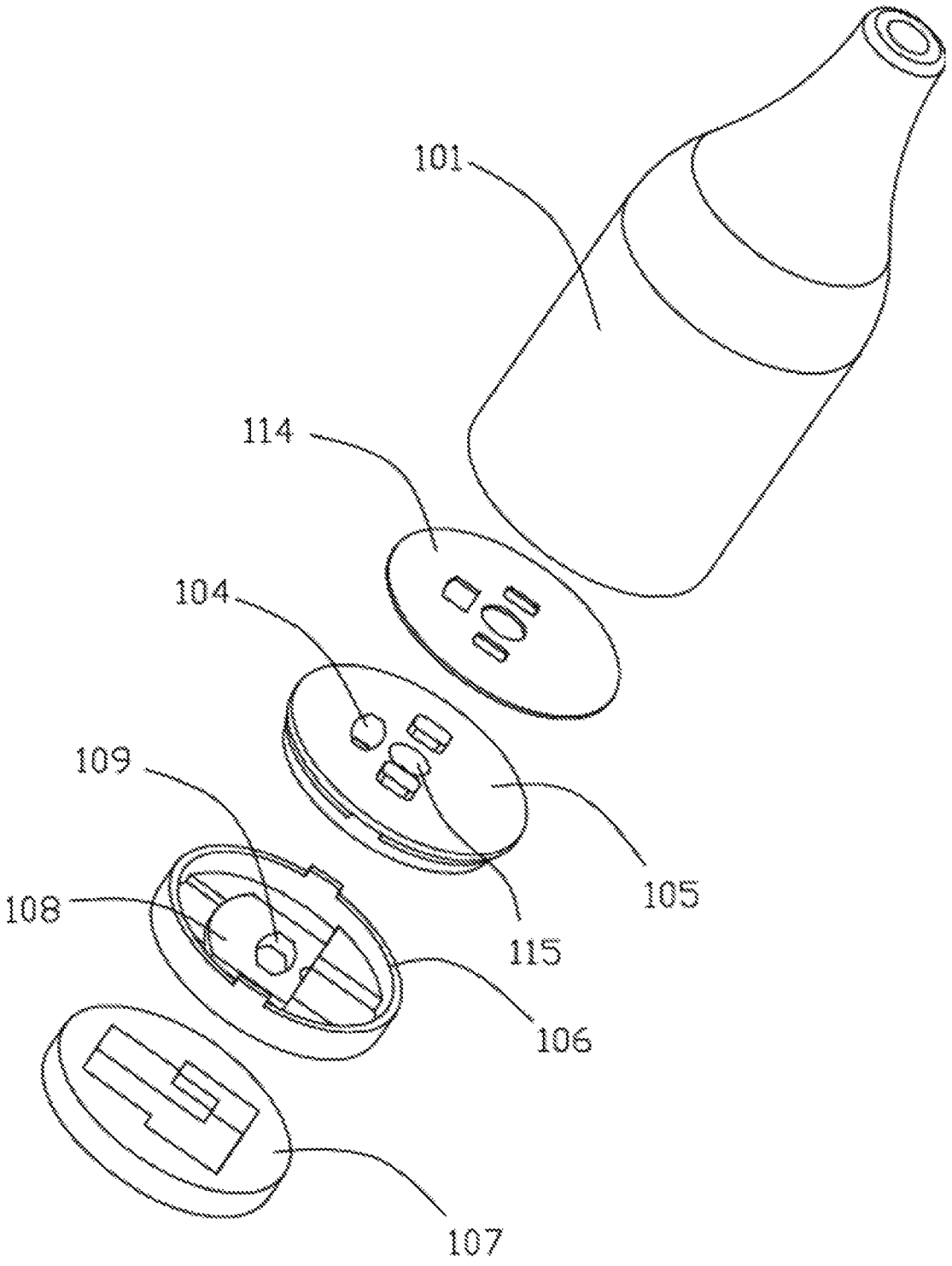
FIG. 2 is an exploded perspective view of the liquid supply of FIG. 1.

Referring to FIGS. 1-2, a liquid supply 10 is shown. The liquid supply 10 is configured (i.e., structured and arranged) for coupling with an atomizing device 20 to form an atomizer. The liquid supply 10 includes a housing 101 and a connecting end 102 at an end of the housing 101. The housing 101 defines a liquid chamber 103 for storing tobacco liquid. A mouthpiece 113 is provided at the other end of the housing 101. An air pipe 112 is further provided in the housing 101. The air pipe 112 extends along an axial direction of the housing 101, and communicates with the mouthpiece 113. An annular space is formed between the air pipe 112 and the housing 101, and serves as the liquid chamber 103. In the present embodiment, the housing 101, the mouthpiece 113 and the air pipe 112 are integrally formed. The connecting end 102 defines a liquid outlet 104. A certain mechanism is used to seal or open the liquid outlet 104, thus controlling flow of tobacco liquid in the liquid chamber.

A sliding block 108 is arranged in the connecting end 102, and slidable between a first position and a second position (the first and second positions will be described in detail later). When the sliding block 108 is in the first position, the sliding block 108 seals the liquid outlet 104. When the sliding block 108 is in the second position, the liquid outlet 104 is opened.

The housing 101 defines an opening at an end, and a sealing element 105 is provided in the end of the housing 101. The sealing element 105 is made of silicone or other resilient material. A fixing plate 114 is provided on the sealing element 105, and configured for supporting the sealing element 105. The sealing element 105 and the fixing plate 114 are both circular in cross-section, and are arranged at an end of the air pipe 112 via central holes, thus sealing the opening of the housing 101. The liquid outlet 104 is defined in the sealing element 105. Quite usefully, the liquid outlet 104 deviates from a central hole 115 of the sealing element 105. Air can flow through the central hole 115. The sliding block 108 is made of hard material, and abuts tightly against a bottom surface of the sealing element 105. The sliding block 108 defines a through hole 109. When the through hole 109 is misaligned with the liquid outlet 104, the sliding block 108 seals the liquid outlet 104; when the through hole 109 is aligned or partially aligned with the liquid outlet 104, the sliding block 108 opens the liquid outlet 104.

Figure 3:
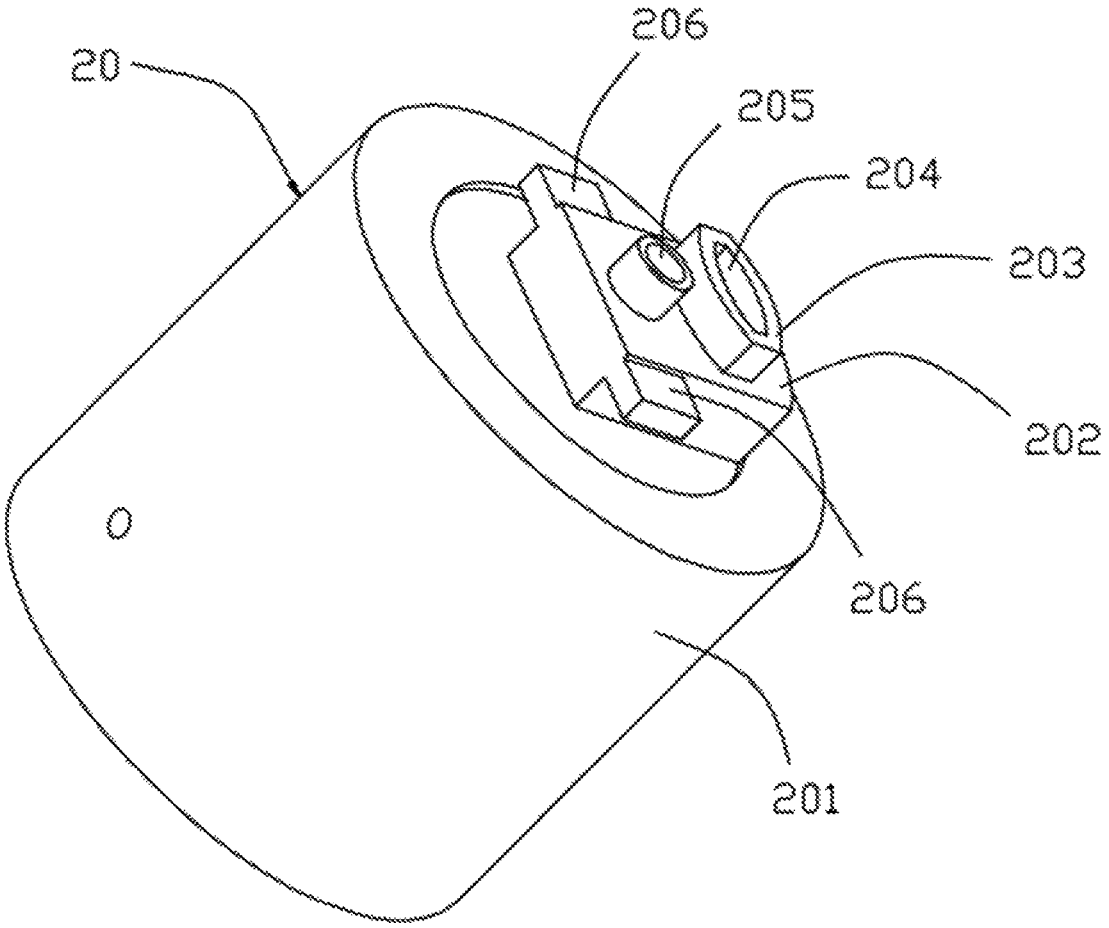
FIG. 3 is a perspective view of an atomizing device, according to a second embodiment.

Referring to FIG. 2, a holder 106 and a guiding element 107 are further provided in the connecting end 102. The sliding block 108 is assembled in the holder 106. The guiding element 107 is configured for guiding an engaging part 202 (as seen in FIG. 3) of an atomizing device 20 to move along a predetermined track. The holder 106 and the guiding element 107 are sequentially arranged below the sealing element 105, and both are fixed in the housing 101. The holder 106 includes a rail, along which the sliding block 108 slides along a straight line. The through hole 109 is substantially elliptic in cross-section. A shape of the through hole 109 is identical with that of the liquid outlet 104. The guiding element 107 defines a run-through cavity, so that the engaging part 202 can pass through the cavity and drive the sliding block 108 to move.

Referring to FIG. 3, the atomizing device 20 includes a main body 201 and the engaging part 202 at an end of the main body 201. The engaging part 202 defines a liquid inlet 204. The liquid inlet 204 is substantially elliptic. A shape of the liquid inlet 204 is identical with that of the liquid outlet 104. Only when the liquid outlet 104 is substantially aligned with the liquid inlet 204, tobacco liquid can flow into the atomizing device 20. The engaging part 202 protrudes from an end surface of the main body 201, so that the engaging part 202 can insert into the cavity in the connecting end 102 to form a snap-fit connection.

Quite usefully, to achieve the snap-fit connection, two latching parts 206 are formed at two opposite sides of the engaging part 202. The guiding element 107 defines an inserting opening 111 and two engaging grooves 110. In the drawings, only one engaging groove 110 is shown (as seen in FIG. 1). The engaging grooves 110 are configured for coupling with the latching parts 206. When the liquid supply 10 is not yet connected with the atomizing device 20, the sliding block 108 is in the first position. The engaging part 202 is capable of sliding along a predetermined track to form the snap-fit connection with the connecting end 102, and simultaneously driving the sliding block 108 to move from the first position to the second position, where the liquid outlet 104 is opened. When the engaging part 202 returns along the predetermined track to be detached from the connecting end 102, the engaging part 202 drives the sliding block 108 to move to the first position where the liquid outlet 104 is sealed again. In the present embodiment, the engaging part 202 slides along a track of a straight line.

To achieve that the engaging part 202 drives the sliding block 108 to move when the engaging part 202 moves, a protruding rod 203 is formed on the engaging part 202, and the liquid inlet 204 is defined in the protruding rod 203. When the engaging part 202 is inserted into the cavity of the guiding element 107, the latching parts 206 are plugged into the inserting opening 111, and the protruding rod 203 is also inserted into the through hole 109 of the sliding block 108. When the latching parts 206 slide along the engaging grooves 110, the protruding rod 203 drives the sliding block 108 to move together. The engaging part 202 defines an air outlet 205. When the sliding block 108 is in the second position, the air outlet 205 aligns with the air pipe 112.

Figure 4:
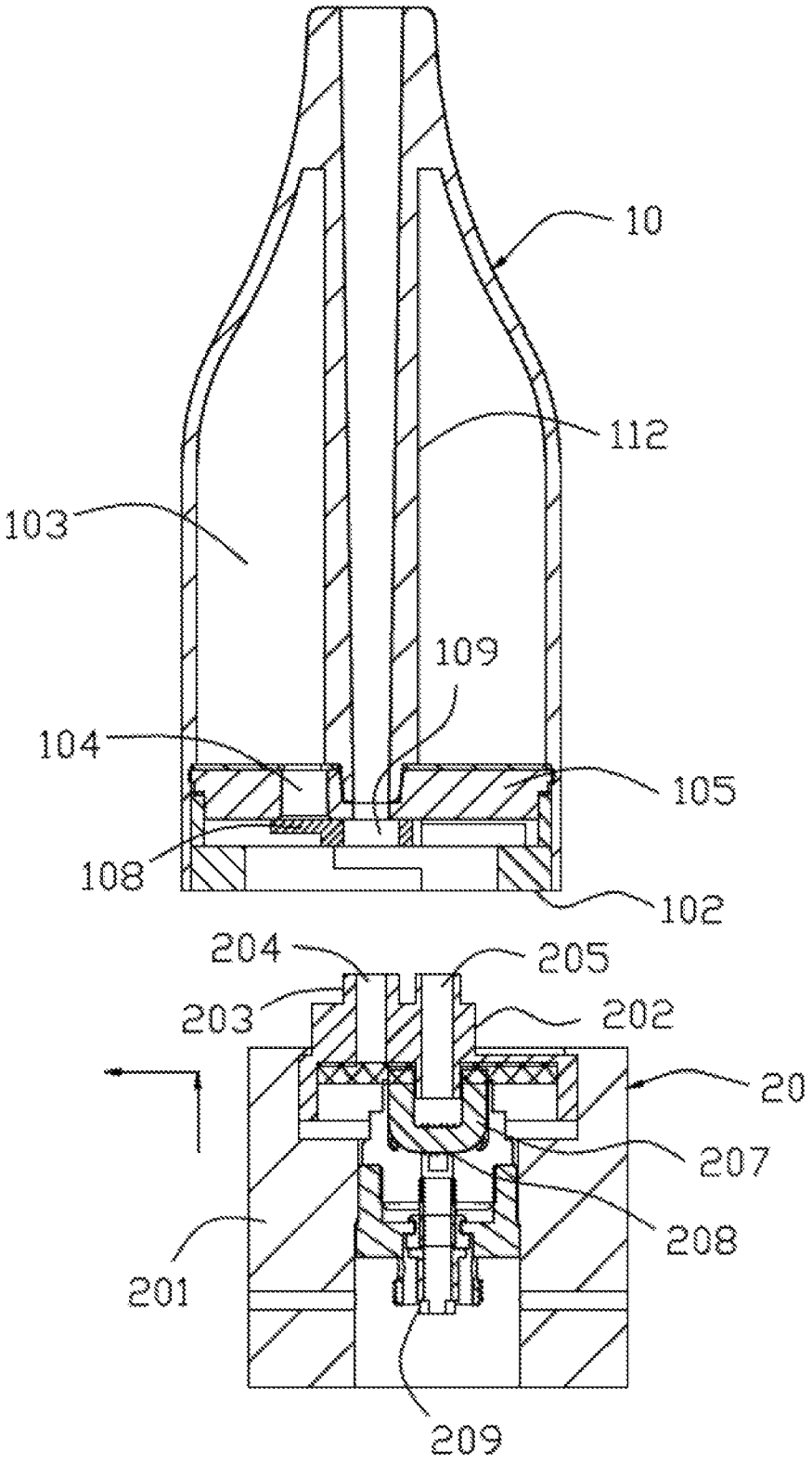
FIG. 4 is a cross-sectional view of an atomizer, including the liquid supply of FIG. 1 and the atomizing device of FIG. 3, the atomizing device including a sliding block, when the liquid supply being unassembled with the atomizing device, and the sliding block being in a first position.
Figure 5:
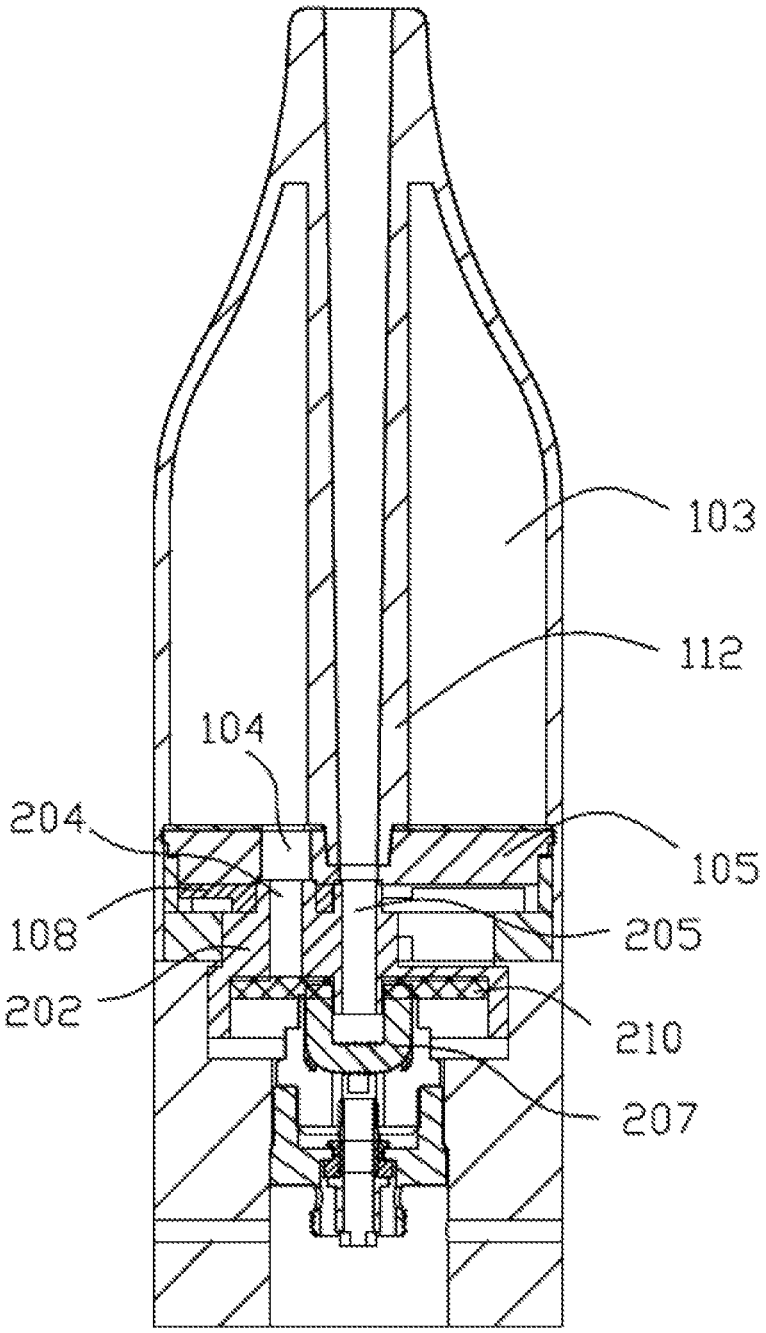
FIG. 5 is a cross-sectional view of an atomizer when the liquid supply is assembled with the atomizing device, and the sliding block being in a second position.

Referring to FIGS. 4-5, when the liquid supply 10 and the atomizing device 20 are not connected, the sliding block 108 is in the first position, the through hole 109 of the sliding block 108 is misaligned with the liquid outlet 104, and the tobacco liquid is sealed. When the liquid supply 10 and the atomizing device 20 are connected with each other, the protruding rod 203 is inserted into the through hole 109, and an outline of the liquid supply 10 is misaligned with that of the atomizing device 20. In the present embodiment, a height of the protruding rod 203 is equal to or slightly larger than a thickness of the sliding block 108, and a top end of the protruding rod 203 tightly abuts against a bottom surface of the sealing element 105. A height of a tubular body, which defines the air outlet 205, is substantially equal to that of the protruding rod 203. When the atomizing device 20 is moved left horizontally, the protruding rod 203 drives the sliding block 108 to slide to the second position. As seen in FIG. 5, in the second position, the liquid outlet 104 is aligned with the liquid inlet 204, the air outlet 205 is in communication with the air pipe 112, and the outline of the liquid supply 10 fits well with that of the atomizing device 20.

The atomizing device 20 further includes a liquid conducting body 207 in the main body 201 and a heating element 208 in the main body 201. The liquid conducting body 207 may be made of glass fiber or porous ceramic. The heating element 208 is usually a heating wire wound around the liquid conducting body 207. When the sliding block 108 is in the second position, the tobacco liquid can flow into the main body 201 via the liquid inlet 204, and the liquid conducting body 207 conveys the tobacco liquid from the liquid inlet 204 to the heating element 208 for atomization. The heating element 208 heats the tobacco liquid to form aerosol, and the aerosol flows into the air pipe 112 via the air outlet 205. To control a releasing speed of tobacco liquid, an annular fiber cotton layer 210 is further provided below the liquid inlet 204, and two opposite ends of the liquid conducting body 207 contacts with the fiber cotton layer 210. The fiber cotton layer 210 can control the tobacco liquid to release slowly to the liquid conducting body 207. An electrode assembly 209 is further provided at a bottom of the main body 201, and is connected to the heating element 208. The heating element 208 is connected to a power supply via the electrode assembly 209.

To detach the liquid supply 10 from the atomizing device 20, the atomizing device 20 is pushed right horizontally relative to the liquid supply 10, the engaging part 202 drives the sliding block 108 to move to the first position, where the liquid outlet 104 is misaligned with the liquid inlet 204. Accordingly, liquid leakage is avoided during the process of detaching. Meanwhile, the latching parts 206 are disengaged from the engaging grooves 110. In the present embodiment, the track of the sliding block 108 and the engaging grooves 110 are both linear, and the engaging part 202 slides along the linear track. It is noteworthy that, in other embodiments, the engaging part 202 may slide along a curved track relative to the liquid supply 10, depending on a shape of a track of the sliding block 108 and the engaging grooves 110.

Figure 6:
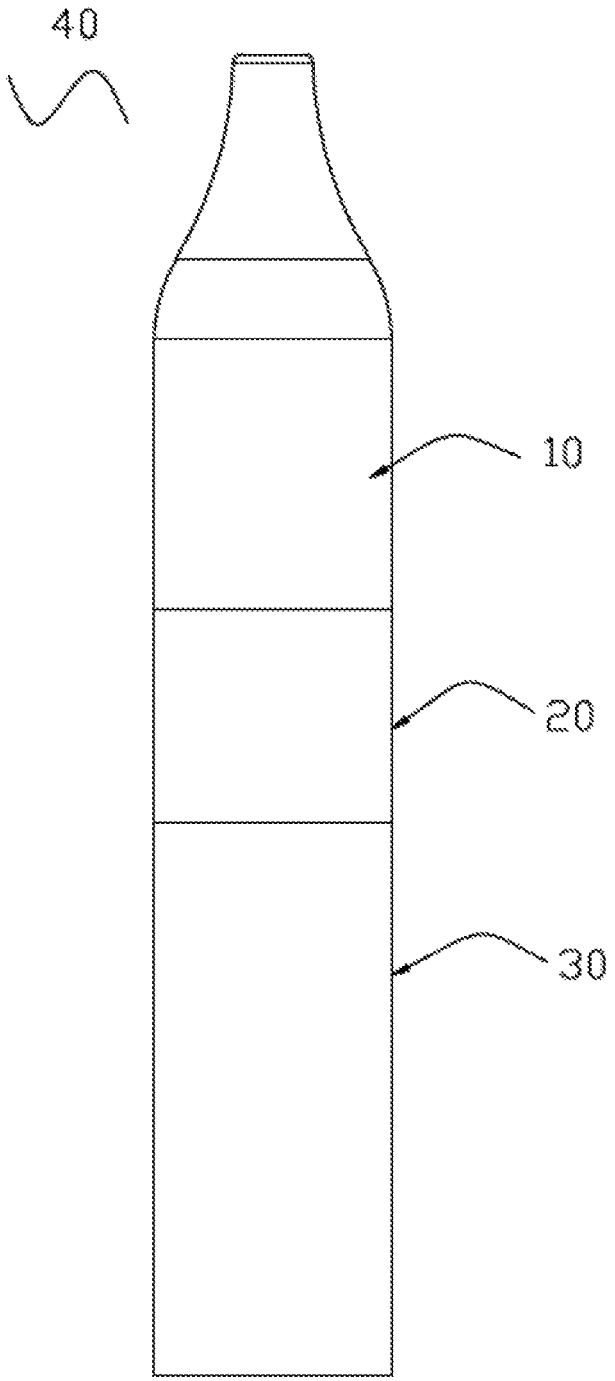
FIG. 6 is an exploded perspective view of an electronic cigarette according to a third embodiment.

Referring to FIG. 6, an electronic cigarette 40 includes the above atomizer and a power supply 30. The above atomizer includes the liquid supply 10 and the atomizing device 20, which will not be described below. The liquid supply 10 is connected to one end of the atomizing device 20, and the power supply 30 is connected to the other end of the atomizing device 20. The power supply 30 is configured for supplying the atomizing device 20 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

an atomizing device comprising an engaging part; and a liquid supply detachably connected with the atomizing device, the liquid supply comprising a liquid chamber, the liquid chamber being configured for storing tobacco liquid, the liquid supply comprising a connecting end and a liquid outlet defined in the connecting end, the engaging part matching with the connecting end, the engaging part defining a liquid inlet through which tobacco liquid can flow into the atomizing device;

wherein the liquid supply further comprises a sliding block slidable between a first position and a second position along a preset direction perpendicular to an axial direction of the liquid supply, when the sliding block is in the first position, the sliding block seals the liquid outlet, when the sliding block is in the second position, the liquid outlet is opened; the engaging part is capable of sliding along a predetermined track along the preset direction to form a snap-fit connection with the connecting end, and simultaneously driving the sliding block to move from the first position to the second position; when the engaging part returns along the predetermined track to be detached from the connecting end, the engaging part is capable of driving the sliding block to move to the first position.

2. The atomizer in accordance with claim 1, wherein the engaging part slides relative to the liquid supply along a linear track or a curved track.

3. The atomizer in accordance with claim 1, wherein the liquid supply further comprises a housing and a sealing element, the housing has an opening at an end, the sealing element is arranged in an end of the housing with the opening, the sealing element is configured for sealing the liquid chamber, the liquid outlet is defined in the sealing element, and the sliding block slides along an end surface of the sealing element.

4. The atomizer in accordance with claim 3, wherein the sealing element is substantially circular in cross-section, and the liquid outlet deviates from a center of the sealing element.

5. The atomizer in accordance with claim 1, wherein the liquid supply further comprises a holder and a guiding element in the connecting end, the sliding block is assembled in the holder, and the guiding element is configured for guiding the engaging part to move along the predetermined track.

6. The atomizer in accordance with claim 5, wherein the atomizing device comprises two latching parts on the engaging parts, the guiding element defines an inserting opening and two engaging grooves, the two latching parts are inserted into the guiding element via the inserting opening, and the engaging grooves are configured for coupling with the latching parts.

7. The atomizer in accordance with claim 1, wherein the atomizing device comprises a protruding rod formed on the engaging part, the liquid inlet is defined in the protruding rod; the sliding block defines a through hole, the protruding rod is capable of inserting into the through hole and driving the sliding block to move.

8. The atomizer in accordance with claim 1, wherein the atomizing device comprises a main body, a liquid conducting body in the main body and a heating element in the main body, the engaging part is arranged at an end of the main body, the liquid conducting body is configured for conveying tobacco liquid flowed from the liquid inlet to the heating element for atomization.

9. An electronic cigarette, comprising:

an atomizer according to claim 1; and a power supply, the liquid supply being connected to a first end of the atomizing device, and the power supply being connected to an opposite second end of the atomizing device, the power supply being configured for supplying the atomizing device power.

10. A liquid supply, comprising:

a housing defining a liquid chamber, the housing having a connecting end at an end thereof, the connecting end defining a liquid outlet;

wherein the liquid supply further comprises a sliding block slidable between a first position and a second position, when the sliding block is in the first position, the sliding block seals the liquid outlet; when the sliding block is in the second position, the liquid outlet is opened;

wherein the liquid supply further comprises a housing and a sealing element, the housing has an opening at an end, the sealing element is arranged in an end of the housing with the opening, the sealing element is configured for sealing the liquid chamber, the liquid outlet is defined in the sealing element, and the sliding block slides along an end surface of the sealing element.

11. An atomizer, comprising:

an atomizing device comprising an engaging part; and a liquid supply detachably connected with the atomizing device, the liquid supply comprising a liquid chamber, the liquid chamber being configured for storing tobacco liquid, the liquid supply comprising a connecting end and a liquid outlet defined in the connecting end, the engaging part matching with the connecting end, the engaging part defining a liquid inlet through which tobacco liquid can flow into the atomizing device;

wherein the liquid supply further comprises a sliding block slidable between a first position and a second position, when the sliding block is in the first position, the sliding block seals the liquid outlet, when the sliding block is in the second position, the liquid outlet is opened;

the engaging part is capable of sliding along a predetermined track to form a snap-fit connection with the connecting end, and simultaneously driving the sliding block to move from the first position to the second position; when the engaging part returns along the predetermined track to be detached from the connecting end, the engaging part is capable of driving the sliding block to move to the first position;

wherein the atomizing device comprises a protruding rod formed on the engaging part, the liquid inlet is defined in the protruding rod; the sliding block defines a through hole, the protruding rod is capable of inserting into the through hole and driving the sliding block to move.

* * * * *